United States Patent [19]

Benisek

[11] 4,447,242

[45] May 8, 1984

[54] TEXTILE FINISHING

[75] Inventor: Ladislav Benisek, Burley-in-Wharfedale, England

[73] Assignee: Wool Development International Limited, London, England

[21] Appl. No.: 443,288

[22] Filed: Nov. 22, 1982

Related U.S. Application Data

[63] Continuation-in-part of Ser. No. 243,601, Jan. 6, 1981, abandoned.

[30] Foreign Application Priority Data

Mar. 14, 1980 [GB] United Kingdom ..... 8008756

[51] Int. Cl.[3] ..... D06M 3/02; D06M 13/20; D06M 9/00

[52] U.S. Cl. ..... 8/128 R; 8/115.7

[58] Field of Search ..... 8/128 R, 115.7

[56] References Cited

U.S. PATENT DOCUMENTS

| | | | |
|---|---|---|---|
| 3,927,962 | 12/1975 | Friedman et al. | 8/128 R |
| 3,950,129 | 4/1976 | Friedman et al. | 8/128 R |
| 3,954,402 | 5/1976 | Benisek | 8/128 R |
| 4,160,051 | 7/1979 | Benisek | 8/128 R |
| 4,201,805 | 5/1980 | Benisek | 8/128 R |

FOREIGN PATENT DOCUMENTS

| | | | |
|---|---|---|---|
| 2548800 | 5/1977 | Fed. Rep. of Germany | 8/127.6 |

*Primary Examiner*—Maria Parrish Tungol
*Attorney, Agent, or Firm*—Andrew D. Maslow

[57] ABSTRACT

A method of finishing keratinous textile fabrics is disclosed which comprises treating the fabrics with an anionic titanium or zirconium complex at a pH in the range 1 to 4, and with a halogen containing organic acid or anhydride soluble in hot water, but preferably virtually insoluble in cold water. Such a treatment enables wool furnishing fabrics to meet the very stringent National Fire Protection Association standard 701-1969.

11 Claims, 1 Drawing Figure

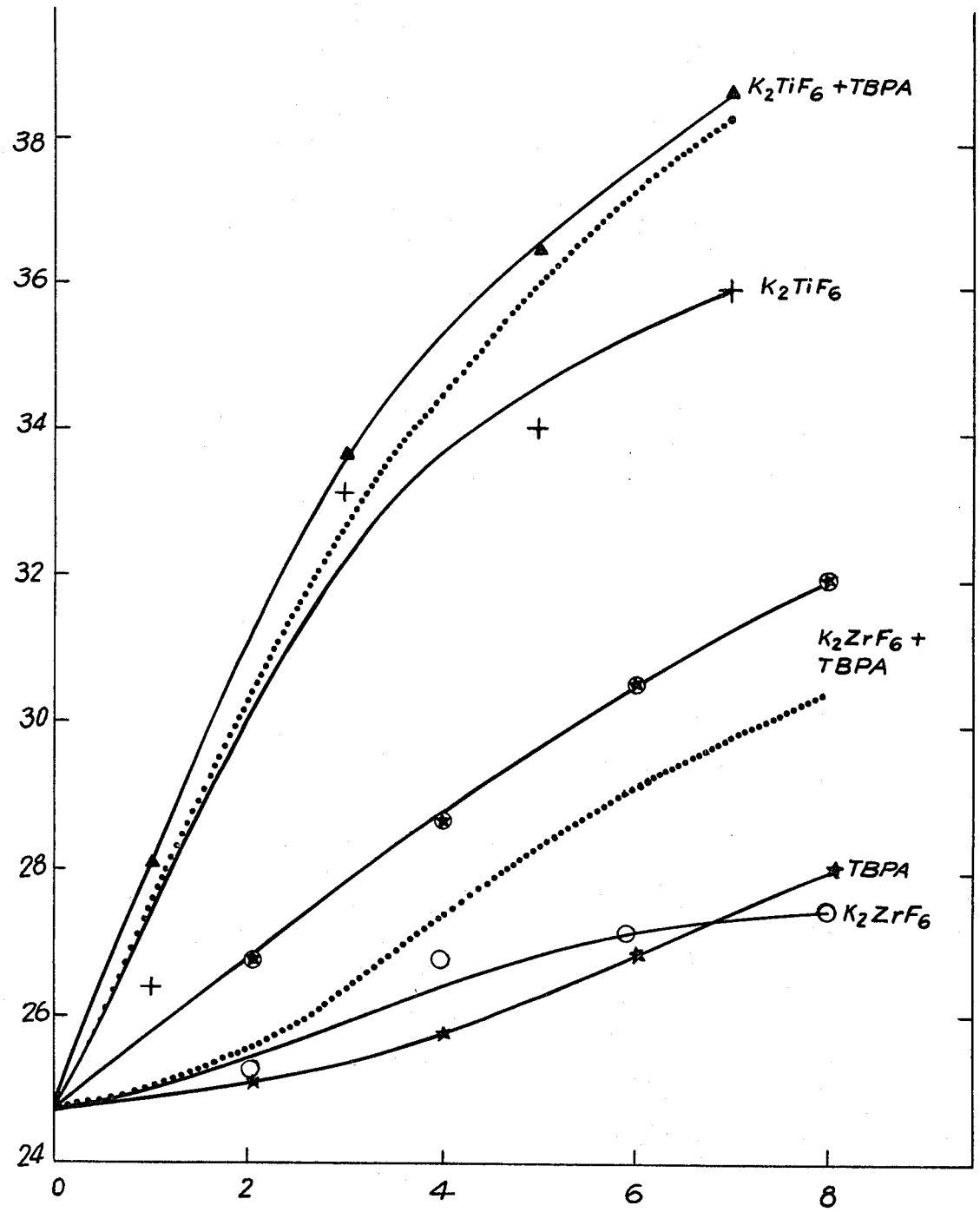
$K_2TiF_6$ +TBPA
$K_2TiF_6$
$K_2ZrF_6$ + TBPA
TBPA
$K_2ZrF_6$
38
36
34
32
30
28
26
24
0
2
4
6
8

TEXTILE FINISHING

This is a continuation-in-part of application Ser. No. 243,601 filed Jan. 6, 1981, now abandoned.

This invention relates to a method of finishing keratinous fibrous textiles to render them flame retardant.

Keratinous fibres, e.g. wool, are naturally flame retardant but increasing stringency of regulations in various countries has meant that certain constructions of wool fabrics, or fabrics for certain end uses, for example in aeroplanes or for protective clothing, require an additional flame retardancy treatment. The titanium and zirconium flame retardancy treatments described in our U.K. Pat. Nos. 1,372,694 and 1,379,752 have proved eminently suitable for improving the flame retardancy of wool textiles to meet the standards imposed by various legislative bodies.

Recently however a new standard is being increasingly adopted in the United States of America for furnishing fabrics. This standard is the National Fire Protection Association (NFPA) standard 701-1969 (standard methods of fire tests for flame resistant textiles and films). It specifies that five specimens shall be dried at 60° to 63° C. for between 1 and 1½ hours and subjected to a vertical flame test in both warp and weft directions with 12 seconds ignition time. None of the ten specimens tested should have an after-flaming time longer than 2 seconds, and the maximum average and individual char lengths are also specified depending on fabric weight. This is an extremely stringent test and many wool furnishing fabrics, even when tested to increase flame retardancy, would be in danger of failing it.

The invention seeks to provide a method of rendering wool furnishing fabrics sufficiently flame retardant to meet the above test.

According to the present invention there is provided a method finishing keratinous textile articles which comprises treating the articles with an anionic titanium or zirconium complex at low pH, and with a halogen-containing organic acid in aqueous solution at elevated temperatures.

The treatment with the anionic titanium or zirconium compound may take place before, after or simultaneously with treatment with the halogenated acid.

The halogen containing organic acid may be supplied as such, or an acid precursor, i.e. a compound which produces the acid under the conditions of treatment, may be used. Because of ease of availability, the acid anhydride is a generally preferred acid precursor.

The organic acid should contain, apart from one or more halogen groups, one or more acidic groups such as carboxy (HOOC—), sulpho ($HO_3S$—), sulphino ($HO_2S$—), sulphamyl ($H_2NO_2S$—) phosphono ($(HO)_2OP$) and/or phosphinico (HOOP=). The halogen containing compound may also be an anhydride, which in acidic conditions and in hot water is converted into its respective acid. The acidic group enables the compound to exhaust at low pH, typically below pH 4, onto the wool fibre which under these conditions contains positively charged amino groups. The acidic group or groups can be attached to a brominated and/or chlorinated aliphatic, aromatic or cyclic chain which can itself contain further reactive groups. It is desirable that the solubility of the halogen containing organic acid in "cold" water i.e., in water up to 50° C., should be very low, for example less than 0.1%, to ensure that the textile treated with such acid is fast to subsequent washing. On the other hand, the solubility of the acid or anhydride should rapidly increase in "hot" water, i.e. above 50° C., to allow exhaustion of the acid from aqueous solution onto the fibre. However, it has been found that, especially where the free acid is employed, application according to the invention, in the presence of an anionic titanium or zirconium complex at low pH, is possible even at temperatures as low as about 50° C. Thus, the phrase "at elevated temperatures" means at temperatures of about 50° C. or more. It is also preferred that, in the case of an halogenated aliphatic acid, the aliphatic chain should contain more than four —$CH_2$— groups to achieve low solubility of the acid in water at temperatures below about 60°. Examples of such acids include: 2,4,6-tribromo, 3-amino benzoic acid; 3,4,5,6-tetrachloropthalic acid or anhydride; chlorendic acid; 2,4,6-tribomo, 3-amino benzene sulphonic acid; sulphobromophthalein; 2-bromo-pentanoic acid; and 2-bromo-actanoic acid. Tetrabromophthalic anhydride (TBPA), or the free acid produced therefrom (TBP Acid), is particularly preferred.

The treatment with titanium or zirconium may be carried out as described in our above U.K. Patents, the entire contents of which are incorporated herein by reference. In brief, the metals are applied, preferably by exhaustion as anionic complexes with fluoride, citrato, or tartrato ions at a pH in the range 1 to 4. The titanium treatment is more effective, weight for weight, than the zirconium treatment but leads to slight yellow colouration and should generally be used only with dark shades or where colouration is immaterial.

The keratinous fibres may be for example mohair, silk, alpaka, vicuna, angora, or especially wool, and the textile article may be in the form of loose stock, slivers, slubbings, rovings, yarns, fabrics, made up garments or carpets; but, as mentioned above, the invention is particularly useful with furnishing fabrics and protective clothing.

The keratinous fibres may be present in the textile articles as a blend with other fibres, natural or synthetic. When articles of fibrous blends are used, it is preferred, but by no means essential, for the blends to be wool rich. Examples of other fibrous materials with which the keratinous fibres can be blended include polyamide, polyester, acrylics, cellulosics, polupropylene, aramid, flame-resist treated cotton, novoloid, polychlal, flame resist treated rayon, modacrylic, polyvinyl chloride, P.B.I., and the like fibrous materials.

The titanium or zirconium treatments may be applied in the ranges of 0.5% to 2.5% or 1% to 5% respectively (calculated as oxides) depending on the substrate and the level of flame retardancy required. Similarly the level of halogen containing acid may be in the range of from 2% to 10% oww, with 4% to 8% being preferred.

Although certain halogen containing acids are known as flame retardancy agents in their own right, none of them is able to meet the very stringent NFPA standard 707-1969, whereas we have surprisingly found that the combination of the invention is able to meet the standard while either component applied separately does not without the application of excessive quantities of chemical, reducing the 'handle' and quality of the treated fabric. While the usefulness of the invention is no way dependent on the correctness of the supposition, it is believed that a synergistic interaction takes place since the titanium/zirconium treatments operate in the solid phase while the halogen containing acid treatment operates in the vapour phase to retard flame propagation.

TABLE I

EFFECT OF VARIOUS FLAME-RETARDANT TREATMENTS ON THE PERFORMANCE OF A 100% WOOL UPHOLSTERY FABRIC ACCORDING TO NFPA 701

| Treatment | Before Cleansing | | | | | After 10 Dry-Cleanings | | | | |
|---|---|---|---|---|---|---|---|---|---|---|
| | Warp | | Weft | | | Warp | | Weft | | |
| | M.B.T. | M.C.L. | M.B.T. | M.C.L. | Result | M.B.T. | M.C.L. | M.B.T. | M.C.L. | Result |
| 1. Untreated | >15 | F.L. | >15 | F.L. | Fail | — | — | — | — | — |
| 2. 10% HCl 37%, 2% TBPA | >15 | F.L. | >15 | F.L. | Fail | — | — | — | — | — |
| 3. 10% HCl 37%, 4% TBPA | >15 | F.L. | >15 | F.L. | Fail | — | — | — | — | — |
| 4. 10% HCl 37%, 6% TBPA | >15 | F.L. | >15 | F.L. | Fail | — | — | — | — | — |
| 5. 10% HCl 37%, 8% TBPA | >15 | F.L. | >15 | F.L. | Fail | — | — | — | — | — |
| 6. 10% HCl 37%, 8% $K_2ZrF_6$ | 4 | 3 | 4 | 3 | Fail | — | — | — | — | — |
| 7. 10% HCl 37%, 2% TBPA, 8% $K_2ZrF_6$ | 3 | 2.5 | 3 | 2.5 | Fail | — | — | — | — | — |
| 8. 10% HCl 37%, 4% TBPA, 8% $K_2ZrF_6$ | 2 | 2.5 | 2 | 2.5 | Pass | 2 | 2.5 | 2 | 2.5 | Pass |
| 9. 10% HCl 37%, 6% TBPA, 8% $K_2ZrF_6$ | 1 | 2 | 1 | 2 | Pass | 1 | 2 | 1 | 2 | Pass |
| 10. 10% HCl 37%, 8% TBPA, 8% $K_2ZrF_6$ | 1 | 2 | 1 | 2 | Pass | 1 | 2 | 1 | 2 | Pass |
| 11. 10% HCl 37%, 4% $K_2TiF_6$ | 3 | 2.5 | 3 | 2.5 | Fail | — | — | — | — | — |
| 12. 10% HCl 37%, 6% TBPA, 4% $K_2TiF_6$ | 1 | 2 | 1 | 2 | Pass | 1 | 2 | 1 | 2 | Pass |
| Performance Requirement | ≦2 | ≦4½ | ≦2 | ≦4½ | | ≦2 | ≦4½ | ≦2 | ≦4½ | |

All treatments applied for 30 minutes at the boil.
M.B.T.—maximum burning time in seconds
M.C.L.—maximum char length in inches
F.L.—full length (12 inches)
TBPA—tetrabromophthalic anhydride was applied in a dispersion with 1% Albegal B (Ciba-Geigy) o.w.w.

The invention will be illustrated further by the following examples.

EXAMPLES 1 TO 12

A 100% wool upholstery fabric, 450 g/m$^2$ (13.2 oz-/yd$^2$), was treated by various flame retardant treatments as shown in Table I below in a winch, at a liquor to goods ratio of 30:1.

Tetrabromophthalic anhydride (TBPA) was dispersed with 1% Albegal B (Ciba-Geigy—dispersing agent), before being added to the bath since it is insoluble in cold water. The treatments described in the following table were started in a cold bath, i.e. at ambient temperature, by the addition of hydrochloric acid (37%), to the liquor containing the fabric to be treated and, after 5 to 10 minutes, adding the TBPA dispersion and/or predissolved potassium flourozirconate or potasium flourotitanate. The bath was then brought to the boil over about 30 minutes and boiling was continued for a further 30 minutes followed by a cold rinse, hydro-extraction, drying and the usual fabric finishing procedure.

The results are summarised in Table I below from which it can be seen that treatment with TBPA alone (examples 2 to 5) fails the NFPA 701 test before cleaning. The same applies to the titanium and zirconium treatments of examples 6 and 11. However, the combination of the TBPA and either titanium or zirconium treatments easily meets the NFPA 701 test (examples 8 to 10 and 12) before and after ten dry-cleanings.

EXAMPLES 13 TO 18

The same fabric as in Examples 1 to 12 was treated by various flame retardant treatments, summarised in Table II, in a winch, at a liquor to goods ratio of 1:30.

In these examples tetrabromophthalic anhydride was converted to its acid form, prior to the treatment, by the following procedure. 1 kg of TBPA was dissolved in 4 kg of a 10% solution of sodium hydroxide, by stirring for about 2 minutes, until dissolution. This converted the anhydride into the soluble sodium salt of the acid. 1 kg of hydrochloric acid 37% was slowly added to the clear solution. This resulted in the neutralisation of the strongly alkaline solution and precipitation of the TBP Acid.

The treatments were carried out as in Examples 1 to 12, except that the required concentration of TBP Acid was used instead of TBPA and the treatment temperatures were as indicated in Table II.

The results summarised in Table II indicate that by applying the TBP Acid, instead of the anhydride, in the presence of the zirconium complexes it is possible to decrease the treatment temperature from the boil to about 50°-60° C. The results also show the beneficial effect of the combined TBP Acid and Zirpro treatment, when compared with treatment with the acid alone.

TABLE II

EFFECT OF TREATMENT TEMPERATURE ON FLAME-RETARDANCE OF 100% WOOL FABRIC ACCORDING TO NFPA 701

| Treatment | Treatment Temperature | | | | | | |
|---|---|---|---|---|---|---|---|
| | 40° C. | 50° C. | 60° C. | 70° C. | 80° C. | 90° C. | 100° C. |
| 13. 3% TBP Acid, 10% HCl 37% | F | F | F | F | F | F | F |
| 14. 4% TBP Acid, 10% HCl 37% | F | F | F | F | F | F | F |
| 15. 7% TBP Acid, 10% HCl 37% | F | F | F | F | F | F | F |
| 16. 3% TBP Acid, Zirpro | F | P | F | F | F | P | P |
| 17. 5% TBP Acid, Zirpro | F | P | P | P | P | P | P |
| 18. 7% TBP Acid, Zirpro | P | P | P | P | P | P | P |

Zirpro—10% HCl 37%, 8% $K_2ZrF_6$
P—Pass NFPA 701
F—Fail NFPA 701

EXAMPLES 19–21

The following fabrics were treated according to the recipe described in Example 17

| Ex. No. | |
|---|---|
| 19. | 90/10 wool/nylon, 290 g/m$^2$, woven |
| 20. | 80/20 wool/nylon, 290 g/m$^2$, woven |
| 21. | 70/30 wool/nylon, 290 g/m$^2$, woven |

This treatment (5% TBP Acid, Zirpro) imparted adequate flame-retardance to all three wool/nylon blends to meet F.A.R. 25.853b. The 90/10 and 80/20 wool/nylon blends also met NFPA 701.

EXAMPLES 22 TO 30

Evaluations were carried out on 100% wool upholstery fabric (412 g/m$^2$), the wool of which had been treated with the chlorine/Hercosett shrink resist treatment in top form. This substrate is difficult to treat adequately with the known Zirpro treatments since they have a reduced fastness to washing when applied to chlorinated wool.

The results are summarised in Table III. Application of TBPA alone gave adequate flame resistance before washing, but after ten washes at 40° C. this effect was lost (examples 22–24).

When the standard and low smoke zirconium treatments were evaluated (examples 25 and 28) similar behaviour was noticed, that is insufficient fastness to washing at 40° C.

However, when TBPA is applied simultaneously with the standard zirconium treatment (examples 26 and 27) and the low smoke zirconium treatments (examples 29, 30) a significant improvement in the fastness to washing is recorded. This combined Zirpro (TBPA) treatment in all cases easily met the requirements of FAR 25.853B.

TABLE III

Effectiveness of Zirpro, TBPA and combined Zirpro/TBPA flame-resist treatments

| Treatment | FAR 25.853b* BW B.T. | BW C.L. | A10W40 B.T. | A10W40 C.L. |
|---|---|---|---|---|
| (1) 5% HCl + 5% TBPA | 2 | 2.1 | >15 | FL |
| (2) 5% HCl + 7% TBPA | 1 | 2.0 | >15 | FL |
| (3) 5% HCl + 9% TBPA | 0 | 2.0 | >15 | FL |
| (4) 5% HCl + 4% citric acid + 8% $K_2ZrF_6$ | 2 | 2.1 | >15 | FL |
| (5) 5% HCl + 4% citric acid + 8% $K_2ZrF_6$ + 5% TBPA | 0 | 2.0 | 6 | 2.7 |
| (6) 5% HCl + 4% citric acid + 8% $K_2ZrF_6$ + 7% TBPA | 0 | 2.0 | 3 | 2.3 |
| (7) 5% HCl + 8% citric acid + 2.3% $K_2ZrF_6$ + 10% $Zr(Ac)_2$ | 3 | 2.1 | >15 | FL |
| (8) 5% HCl + 8% citric acid + 2.3% $K_2ZrF_6$ + 10% $Zr(Ac)_2$ + 5% TBPA | 0 | 2.0 | 5 | 2.6 |
| (9) 5% HCl + 8% citric acid + 2.3% $K_2ZrF_6$ + 10% $Zr(Ac)_2$ + 7% TBPA | 0 | 2.0 | 2 | 2.4 |

All treatments applied by the exhaustion technique, 30 min. at 60° C., liquor ratio 1:30.
TBPA—tetrabromophthalic acid
*Average of 6 tests
BW—before washing
A10W40—after 20 washes at 40° C.
B.T.—burning time in seconds
C.L.—char length in inches
FL—full length (12 inches)

This finding is unexpected in that the wash resistance of the two treatments would not be expected to be additive. That is, if two treatments of poor fastness are combined one would expect the combined treatment to exhibit poor fastness also. However, as can be seen from Table III, although either of the treatments applied alone failed after ten washes at 40° C., the combined treatment easily passed the flame retardancy test after ten washes at 40° C. This unexpected finding, together with the unexpected finding of superior flame retardancy properties, also points to the synergistic effect of the combined treatments of the present invention.

EXAMPLE 31

In order to demonstrate the synergistic interaction of the combined flame retardant treatment of the instant invention comparative tests were carried out on a 100% wool fabric using five different treatments.

The treatments were all carried out by the exhaustion technique at a liquor ratio of 1:30 for 30 minutes at 70° C. In each case the amount of flame retardant applied was noted and the limiting oxygen index (LOI) of the treated fabric was measured, and the results are shown graphically in FIG. 1 appended hereto.

The flame retardants applied to the fabric were as follows:

(a) potassium fluorozirconate alone
(b) TBPA alone
(c) potassium hexafluorotitinate alone
(d) potassium hexafluorotitinate and TBPA
(e) potassium hexafluorozirconate and TBPA.

In each case 10% hydrochloric acid was present, as in previous examples.

Reference to FIG. 1 shows the following. The degree of flame retardancy, as measured by the LOI, given by either TBPA or potassium hexafluorozirconate alone is not linear with amount of retardant applied. The lower dotted graph is produced by mathematically summing the TBPA and $K_2ZrF_6$ curves, and therefore represents the expected additive effect of the combined Zirpro and TBPA treatment. As can be seen from FIG. 1 the measured result, as shown by the fourth curve from the bottom marked $K_2ZrF_6$++TBPA indicates that the flame retardancy actually imparted is consistently greater than the theoretical expectation at all concentration levels.

Similarly, the upper dotted curve is the theoretical summation of the TBPA curve and the $K_2TiF_6$ curve. Once again it can be seen that this is at all concentrations below the measured result as indicated in the upper curve marked $K_2TiF_6$+TBPA, again indicating a synergistic interaction of the combined process of the present invention.

The LOI test is one in which a strip of material is supported in a vertical glass tube and ignited at the top edge in the presence of a mixture of oxygen and nitrogen of predetermined composition. The LOI for a given strip of material is the percentage of oxygen which has to be present in the mixture of gases in order just to maintain flaming combustion of the strip. Consequently, if the flame retardant treatment is effective, a large percentage of oxygen in the gaseous mixture is required resulting in high LOI figure. Thus the LOI test is a good measure of relative effectiveness of different flame retardancy treatments. For comparison, the LOI of the untreated fabric used in this example is 24.8.

EXAMPLES 32–42

The flame retardancy treatments, both Zirpro and TBPA, are applied under acid conditions. It often happens that a fabric which has had one of these treatments applied is subjected to further processing, for example dyeing or scouring. If the further processing is carried out under alkaline conditions the fastness of the flame retardancy treatment is adversely affected by neutralisation of the fabric.

Three fabrics, as follows, were treated as described hereinafter.

(a) 100% wool, undyed, plain weave fabric 197 g/m$^2$
(b) 100% wool, orange, gabardine fabric, 276 g/m$^2$
(c) 100% wool, multicoloured, jacquard upholstery fabric, 450 g/m$^2$.

The flame retardancy treatments were applied as described herebefore. In the case of the potassium fluorotitinate treatment, 6% OWW was applied. After the flame retardant treatment, the fabrics were neutralised with 12% sodium bicarbonate OWW for 30 minutes at 40° C. This ensured a wool pH extract of 6.5–7.0. The results are summarised in Table IV.

Before neutralisation all the treatments on all fabrics easily met the requirements of FAR 24.853B (Air worthiness standards: transport category airplanes, Federal Register 37, 3971–3973 (1972).). This test specifies that a vertical sample of fabric has a flame applied to its base for a given length of time and then removed, after which the maximum burning time of the fabric must not exceed 15 seconds, and the maximum length of char after all burning is extinguished, must be less than 20 cm.

the flame retardance after neutralisation, especially at the higher TBPA levels. The titanium treatment was fast to neutralisation on two of the fabrics evaluated but addition of TBPA in this case enabled decreased char length measurements to be obtained in the vertical flame test. The titanium treatment is known to be more effective than the zirconium one, but is often less preferred commercially owing to the yellow colouration which can be imparted to the fabric.

This unexpected improvement in the fastness of the Zirpro/TBPA treatment to neutralisation when compared to the performance of the individual flame retardant treatment alone, is further evidence of the synergism of the combined treatment of the instant invention.

I claim:

1. A method of finishing keratinous textile articles which comprises treating the articles with an anionic titanium or zirconium complex at low pH, and with a bromo or chloro containing organic acid in aqueous solution at elevated temperature.

2. A method as claimed in claim 1 in which the bromo or chloro containing organic acid is supplied as an acid precursor.

3. A method as claimed in claim 1 in which the bromo or chloro containing organic acid contains, apart from one or more halogen groups, one or more acidic groups such as carboxy, sulpho, sulphino, sulphamyl, phosphono or phosphinico.

4. A method as claimed in claim 1 in which the halogen containing bromo or chloro containing organic acid is soluble in hot water and insoluble in cold water.

5. A method as claimed in claim 1 in which the halogen containing bromo or chloro containing organic acid or precursor is a tetrabromophthalic anhydride or free tetrabromophthalic acid.

6. A method as claimed in claim 1 in which the level of bromo or chloro containing organic acid applied to the textile article is in the range of 2% to 10% by weight.

7. A method as claimed in claim 1 in which the anionic titanium or zirconium complexes are complexes with fluoride, citrato, or tartrato ions applied at a pH in the range of from 1 to 4 and at a level of from 0.5% ti 2.5% or from 1% to 5% respectively (calculated as oxide).

TABLE IV

EFFECT OF NEUTRALISATION ON FLAME-RETARDANCE OF ZIRPRO, TBPA AND ZIRPRO/TBPA TREATED WOOL

| | | FLAME-RETARDANCE (F.A.R. 25.853 b)[1] | | | | | | | | | | | |
|---|---|---|---|---|---|---|---|---|---|---|---|---|---|
| | | Fabric A | | | | Fabric B | | | | Fabric C | | | |
| | | Warp | | Weft | | Warp | | Weft | | Warp | | Weft | |
| Example No: | Treatment* | B.T. | C.L. | B.T. | C.L. | B.T. | C.L. | B.T. | C.L. | B.T. | C.L. | B.T. | C.L. |
| 32 | (1) 5% TBPA | >15 | F.L. | >15 | F.L. | >15 | F.L. | >15 | F.L. | >15 | F.L. | >15 | F.L. |
| 33 | (2) 10% TBPA | 3.5 | 17.5 | >15 | F.L. | >15 | F.L. | >15 | F.L. | >15 | F.L. | >15 | F.L. |
| 34 | (3) 15% TBPA | 0 | 15.9 | 4 | 16.7 | 0 | 10.9 | >15 | F.L. | >15 | F.L. | >15 | F.L. |
| 35 | (4) Zirpro (Zr) | 1 | 16.2 | 4 | 17.5 | >15 | F.L. | >15 | F.L. | >15 | F.L. | >15 | F.L. |
| 36 | (5) Zirpro (Zr), 3% TBPA | 0 | 12.7 | 0 | 12.2 | >15 | F.L. | >15 | F.L. | 8 | 8.1 | 11 | 9.1 |
| 37 | (6) Zirpro (Zr), 5.5% TBPA | 1 | 10.7 | 2 | 10.2 | 0 | 7.6 | 3 | 9.5 | 3 | 5.1 | 5 | 6.1 |
| 38 | (7) Zirpro (Zr), 8% TBPA | 0 | 9.1 | 2 | 9.1 | 4 | 7.6 | 2 | 9.5 | 2 | 4.1 | 2 | 4.8 |
| 39 | (8) Zirpro (Ti) | 1 | 16.7 | 0 | 16.5 | 1 | 10.2 | 5 | 11.7 | — | — | — | — |
| 40 | (9) Zirpro (Ti), 3% TBPA | 1 | 15.0 | 0 | 11.7 | 2 | 9.4 | 1 | 9.6 | — | — | — | — |
| 41 | (10) Zirpro (Ti), 5.5% TBPA | 0 | 11.7 | 0 | 11.4 | 2 | 6.9 | 0 | 8.9 | — | — | — | — |
| 42 | (11) Zirpro (Ti), 8% TBPA | 0 | 8.9 | 1 | 7.9 | 1 | 8.2 | 0 | 8.6 | — | — | — | — |

*Each Treatment was followed by neutralisation.
B.T.—Burning Time in seconds.
C.L.—Char Length in cm.
F.L.—Full Length (30 cm).

With the exception of the lighter weight fabric, fabric (a), neither the TBPA nor zirconium treatments were fast to neutralisation. A simultaneous application of zirconium and TBPA treatments significantly improved 8. A method as claimed in claim 1 in which the keratinous textile article is a fabric made from wool fibres either alone or blended with other textile fibres.

9. A method as claimed in claim 1 in which the titanium or zirconium treatment is carried out with potassium hexafluorozirconate or hexafluorotitanate.

10. A method as claimed in claim 1 wherein the solubility of the bromo or chloro containing organic acid in water having a temperature of up to 50° C. is less than 0.1%.

11. A method as claimed in claim 1 in which the bromo or chloro containing organic acid contains a aliphatic chain of more than four —$CH_2$-groups.

* * * * *